United States Patent [19]

Pinson

[11] Patent Number: 4,796,833

[45] Date of Patent: Jan. 10, 1989

[54] OPTICAL FIBER GUIDED TUBE-LAUNCHED PROJECTILE SYSTEM

[75] Inventor: George T. Pinson, Huntsville, Ala.

[73] Assignee: The Boeing Company, Seattle, Wash.

[21] Appl. No.: 93,599

[22] Filed: Sep. 8, 1987

Related U.S. Application Data

[63] Continuation-in-part of Ser. No. 032,448, Mar. 31, 1987.

[51] Int. Cl.[4] ..... F41G 7/32

[52] U.S. Cl. ..... 244/3.12

[58] Field of Search ..... 244/3.12; 89/1.34, 1.8, 89/1.816, 1.817

[56] References Cited

U.S. PATENT DOCUMENTS

| | | | |
|---|---|---|---|
| 3,233,548 | 2/1966 | Chilowsky | 244/3.12 |
| 3,296,927 | 1/1967 | Olsson et al. | 89/1.8 |
| 4,185,796 | 1/1980 | Riley | 244/3.12 |
| 4,573,647 | 3/1986 | Laten et al. | 244/3.12 |
| 4,611,771 | 9/1986 | Gibbons et al. | 244/3.12 |
| 4,615,496 | 10/1986 | Pinson | 244/3.16 |

*Primary Examiner*—Charles T. Jordan

*Attorney, Agent, or Firm*—Finnegan, Henderson, Farabow, Garrett & Dunner

[57] ABSTRACT

In an optical fiber guided projectile system for firing a projectile having trailing and leading ends from a generally tubular launcher and for guiding the projectile to a target wherein the projectile includes an extended length of optical fiber disposed form streaming from the trailing end of the projectile during flight and wherein, prior to firing, a portion of the optical fiber extends from the trailing end of the projectile axially along the inner surface of the tubular launcher and through the mouth of the launcher to a controller, the improvement comprises a generally resilient plug disposed in the launcher between the leading end of the projectile and the mouth of the launcher, the plug securing the portion of the optical fiber in axial orientation along the inner surface of the tubular launcher during firing of the projectile.

7 Claims, 2 Drawing Sheets

OPTICAL FIBER GUIDED TUBE-LAUNCHED PROJECTILE SYSTEM

This application is a continuation-in-part of U.S. patent application Ser. No. 032,448, filed Mar. 31, 1987.

BACKGROUND OF THE INVENTION

1. Field of the Invention

This invention relates to an optical fiber guided projectile system, and more particularly, to an improved optical fiber projectile system in which the projectile may be fired from an elongated tubular launcher without damage to the optical fiber.

2. Description of Related Art

This application is directed to an improvement of the invention disclosed in co-pending U.S. patent application Ser. No. 07/032,448, filed March 31, 1987. The disclosure of U.S. patent application Ser. No. 07/032,448 is specifically incorporated by reference for the purpose of providing a description of related art and background information on the function and operation of the projectile system improved by the invention of this application.

This subject invention provides an optical fiber guided projectile system wherein the projectile may be fired from a tubular launcher having a length significantly greater than the projectile wherein the optical fiber deployment is effected without damage to the optical fiber during launch.

The objects and advantages of the invention will be set forth in part in the description which follows, in part will be apparent from the description, and in part may be obtained by reference to co-pending application Ser. No. 07/032,448, or may be learned by practice of the invention. The objects and advantages of the invention may be realized and attained by means of the instrumentalities and combinations particularly pointed out in the appended claims.

SUMMARY OF THE INVENTION

In accordance with the invention, as embodied and broadly described herein, in an optical fiber guided weapon system for firing a projectile having trailing and leading ends from a generally tubular launcher and guiding the projectile to a target wherein the projectile includes an extended length of optical fiber disposed for streaming from the trailing end of the projectile during flight and wherein, prior to firing, a portion of the optical fiber extends from the trailing end of the projectile axially along the inner surface of the tubular launcher through the mouth of the launcher to a control means, the improvement comprises a generally resilient plug disposed in the launcher between the leading end of the projectile and the mouth of the launcher, the plug securing the portion of the optical fiber in axial orientation along the inner surface of the tubular launcher during firing of the projectile.

Preferably, the plug includes a plurality of axial holes for release of gas pressure generated in the launcher during firing.

In a preferred embodiment, the end of the plug proximate the leading end of the projectile is shaped to receive and protect the leading end of the projectile during launch.

While the plug is preferably one piece, alternatively the plug may comprise a plurality of discs of resilient material disposed in the launcher in axially spaced relation, each disc including axial holes for release of gas pressure.

The invention resides in the novel parts, construction, arrangements, combinations and improvements shown and described. The accompanying drawings, which are incorporated in and constitute a part of this specification, illustrate the presently preferred embodiments of the invention and, together with the description, serve to explain the principles of the invention.

DESCRIPTION OF THE PREFFERD EMBODIMENTS

Reference will now be made to the present preferred embodiments of the invention, examples of which are illustrated in the accompanying drawings.

Figure 1:
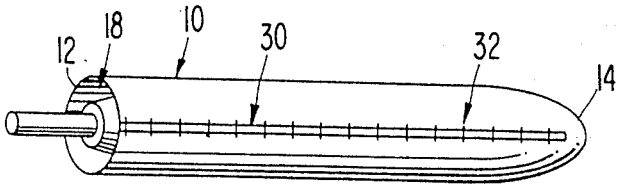
FIG. 1 is a graphic perspective view of an optical fiber guided projectile for use with the invention.
Figure 1A:
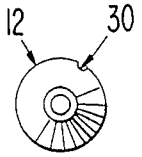
FIG. 1A is a graphic representation of the trailing end of the projectile of FIG. 1.
Figure 2:
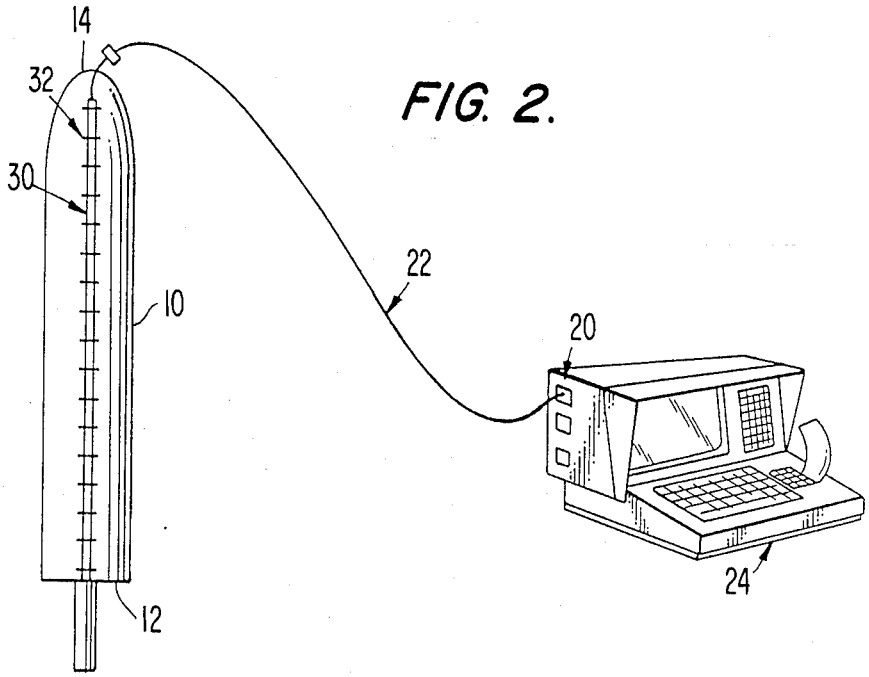
FIG. 2 is a graphic representation of the projectile of FIG. 1 and the command/control console elements of the projectile system of the invention.
Figure 3:
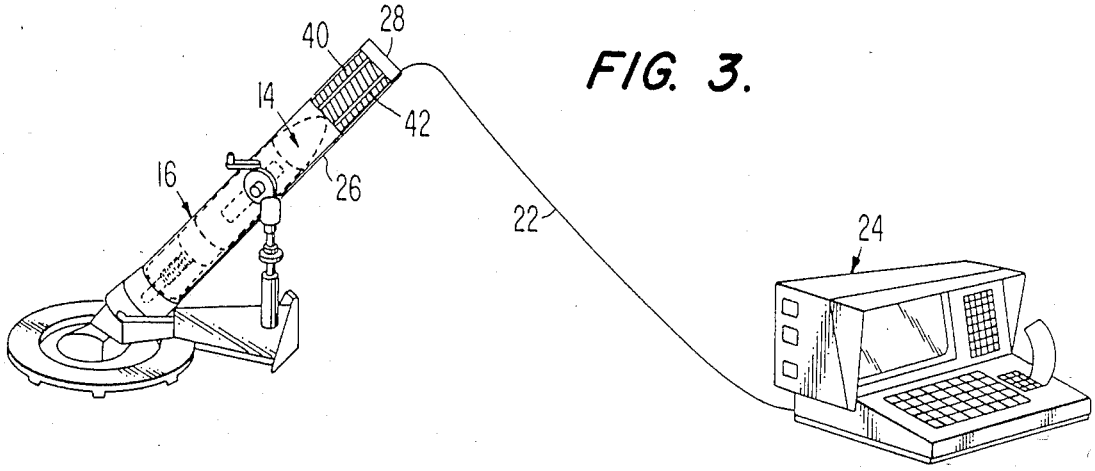
FIG. 3 is a perspective view of the weapon system of the invention.

The optical fiber guided projectile system to which the subject invention is an improvement includes, referring to FIGS. 1, 2 and 3, a projectile 10 having a trailing end 12 and a leading end 14 and being designed to be fired from a generally tubular launcher 16. The projectile 10 includes an extended length 18 of optical fiber 22 disposed for streaming from trailing end 12 during flight. The other end 20 of optical fiber 22 extends from projectile 10 to a controller 24 to provide guidance of the projectile to a target.

Figure 4A:
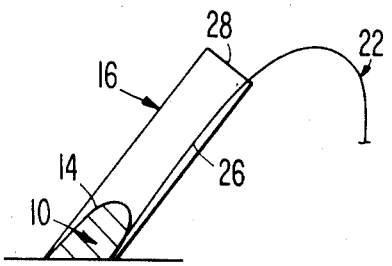
FIGS. 4A, 4B and 4C are graphic sequential views depicting the effect on optical fiber without use of the improvement of the invention.
Figure 4B:
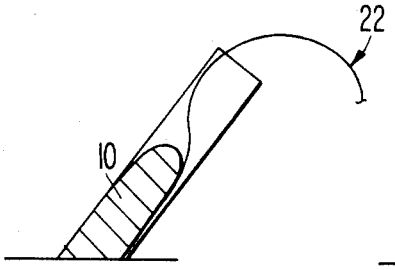
Figure 4C:
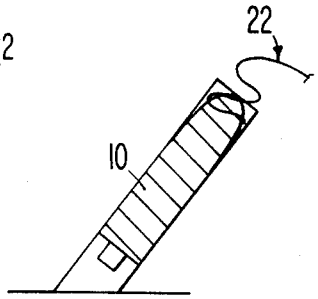

When projectile 10 is disposed in launcher 16, prior to firing, a portion 26 of optical fiber 22 extends from trailing end 12 of projectile 10 axially along the inner surface of tubular launcher 16 and through mouth 28 of launcher 16 to controller 24. In order to accommodate passage of fiber portion 26 between projectile 10 and the inner wall of launcher 16 without adversely effecting the propulsive force of the launch and in order to protect the fiber during launch, projectile 10 includes axial grove 30 through which portion 26 of fiber 22 passes from trailing end 12 to leading end 14 of projectile 10. Means, such as tape 32, are provided to retain fiber portion 26 in groove 30 until projectile 10 exits launcher 16.

Where projectile 10 is fired from a tubular launcher having an axial length substantially greater than the projectile, such as in a 120 mm mortar, a substantial length of fiber portion 26 extends axially along the wall of launcher 16 without support otherwise provided by groove 30 in projectile 10. This unsupported distance may be in excess of 20 inches. Where optical fiber portion 26 does not have the columnar strength to withstand loads imposed during firing of the projectile, the fiber may partially or completely collapse during launch which could adversely effect the optical performance of the fiber. FIG. 4A graphically depicts projectile 10 in elongated launcher 16 wherein a portion 26 of fiber 22 extends axially from leading end 14 of projectile 10 to mouth 28 of launcher 16 without substantial support. As depicted in FIGS. 4B and 4C, movement of projectile 10 through launcher 16 durnig firing tends to collapse fiber 22. The bends imposed on fiber 22 in such a situation could break or crack the fiber to the detriment of performance of the system.

In accordance with the invention, the improvement to the weapon system comprises a generally resilient plug disposed in the launcher between the leading end of the projectile and the mouth of the launcher, the plug securing the portion of the optical fiber in axial orientation along the inner surface of the tubular launcher during firing of the projectile. As embodied herein and depicted in FIGS. 3 and 5, generally resilient plug 40 is disposed in launcher 16 between leading end 14 of projectile 10 and mouth 28 of launcher 16. The plug, which may be of plastic, foam or other suitable material, is stuffed, or interference fitted in launcher 16. Plug 40 secures length 26 of fiber 22 in axial orientation along the inner surface of launcher 16 during firing of projectile 10.

Figure 5:
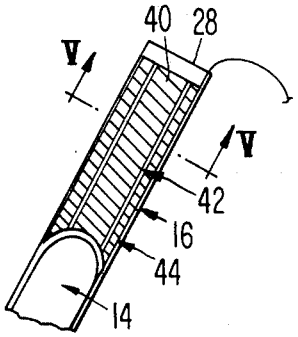
FIG. 5 is an enlarged cross-sectional view of the improved component of the invention.
Figure 5A:
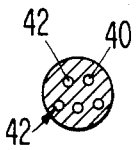
FIG. 5A is a cross-sectional view of the improved component of FIG. 5 taken long lines V—V.

Preferably, plug 40 includes a plurality of axial holes or bores 42 as particularly seen in FIG. 5A. Holes 42 in plug 40 relieve gaseous pressure build-up behind plug 40 during launch to preclude premature ejection of plug 40 from launcher 16.

Because an optical guided projectile generally includes a glass or plastic dome on the leading end 14 thereof, it may be preferred to include in plug 40 on the end thereof proximate leading end 14 of projectile 10 protection for the glass or plastic dome. As depicted in FIG. 5, such protection may be achieved by shaping the end 44 of plug 40 to conform with leading end 14. Such shaping avoids concentration of forces at one point on leading edge 14. Alternatively, in lieu of shaping one end of plug 40, a separate shaped plug, perhaps made of more resilient material than plug 40, could be inserted prior to insertion of plug 40 into launcher 16.

Figure 6:
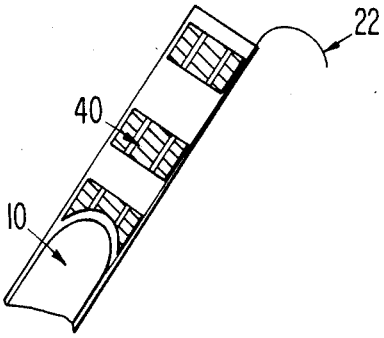
FIG. 6 is an enlarged cross-sectional view similar to that of FIG. 5 depicting an alternative embodiment of the improved component of the invention.

An alternative embodiment of plug 40 is depicted in FIG. 6 wherein plug 40 is composed of a plurality of axially spaced discs each including axial holes for gaseous pressure release. Preferably such disks are inserted individually and spaced a distance insufficient to permit collapse of fiber during launch. Spacing of no more than five inches may be appropriate depending on the type of optical fiber in use.

It will be apparent to those skilled in the art that various modifications or variations could be made of the projectile system of the invention without departing from the scope or spirit of the invention.

What is claimed is:

1. In an optical fiber guided projectile system for firing a projectile having trailing and leading ends from a generally tubular launcher and for guiding the projectile to a target, wherein the projectile includes an extended length of optical fiber disposed for streaming from the trailing end of the projectile during flight and wherein, prior to firing, a portion of the optical fiber extends from the trailing end of the projectile axially along the inner surface of the tubular launcher and through the mouth of the launcher to a control means, the improvement comprising:

a generally resilient plug disposed in the launcher between the leading end of the projectile and the mouth of the launcher, said plug securing said portion of the optical fiber in axial orientation along the inner surface of the tubular launcher during firing of said projectile.

2. The system of claim 1 wherein said plug is made of plastic.

3. The system of claim 1 wherein said plug forms an interference fit in said launcher.

4. The system of claim 1 wherein said plug includes a plurality of axial holes for release of gas pressure generated in the launcher during firing.

5. The system of claim 1 including means disposed between said plug and the leading end of said projectile for protecting the leading end of said projectile from damage during launch.

6. The system of claim 1 wherein the end of said plug proximate the leading end of said plug proximate the leading end of said projectile is shaped to receive and to protect the leading end of said projectile during launch.

7. The system of claim 1 wherein said plug comprises a plurality of discs of resilient material for disposition in said launcher in axially spaced relation, each said disc including axial holes for release of gas pressure.

* * * * *